US007201667B2

(12) United States Patent
Dorman

(10) Patent No.: US 7,201,667 B2
(45) Date of Patent: Apr. 10, 2007

(54) DEVICE TO IMPROVE PUTTING

(76) Inventor: Daniel W. Dorman, 3643 S. New Haven, Tulsa, OK (US) 74135

( * ) Notice: Subject to any disclaimer, the term of this patent is extended or adjusted under 35 U.S.C. 154(b) by 13 days.

(21) Appl. No.: 11/225,513

(22) Filed: Sep. 14, 2005

(65) Prior Publication Data

US 2007/0060411 A1 Mar. 15, 2007

(51) Int. Cl.
*A63B 69/36* (2006.01)

(52) U.S. Cl. ..... 473/251; 473/260

(58) Field of Classification Search ..... 473/218, 473/226, 242, 251, 257, 258, 260, 261, 266
See application file for complete search history.

(56) References Cited

U.S. PATENT DOCUMENTS 3,471,155 A 10/1969 Donaldson
5,007,646 A 4/1991 Baber et al.
5,024,442 A 6/1991 Sindelar, Sr.
5,072,943 A 12/1991 Sindelar
5,125,665 A 6/1992 Sindelar, Sr.
5,150,904 A 9/1992 Sindelar
6,561,920 B1 5/2003 Hamilton

*Primary Examiner*—Nini F. Legesse
(74) *Attorney, Agent, or Firm*—William S. Dorman

(57) ABSTRACT

A device to aid golfers in improving their putting game comprising in combination with a putter, a straight edge guide and an attachment for the putter head, the putter head attachment comprising an elongated flat vertical base plate which extends horizontally and is adapted to slide against a horizontal flat surface on the guide, a first vertical arm extending perpendicularly in a vertical plane from the base plate, a horizontal arm extending from an upper edge of the first vertical arm in a horizontal plane from an end of the first vertical arm opposite its attachment to the base plate, the horizontal arm extending in spaced relation with respect to the base plate, the horizontal arm forming a right angle with the first vertical arm so as to extend over an uppermost portion of the putter head, a second vertical arm attached to an end of the horizontal arm opposite from its attachment to the first vertical arm and extending downwardly in parallel relation with the first vertical arm, the putter head being grasped between the first and second vertical arms.

6 Claims, 4 Drawing Sheets

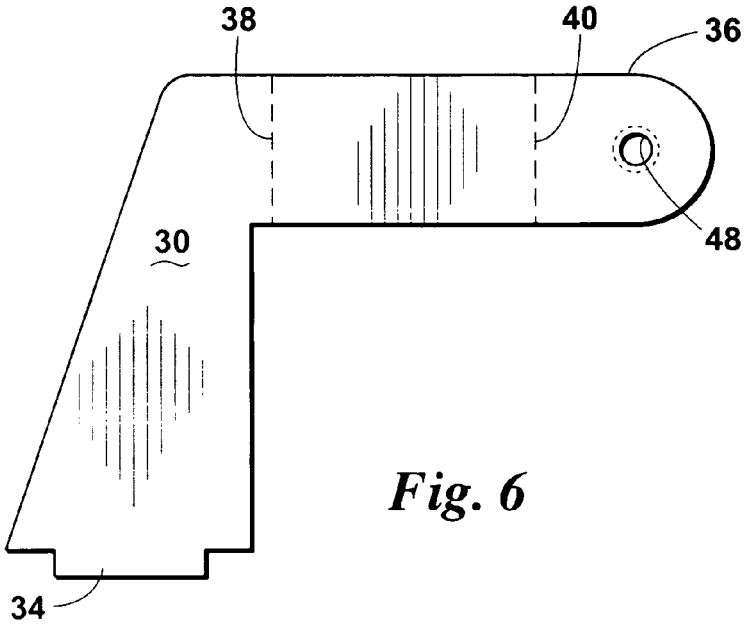
Fig. 6
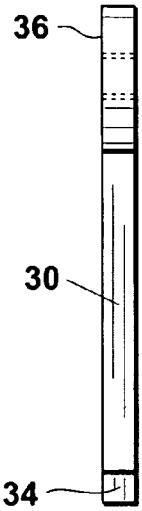
Fig. 7
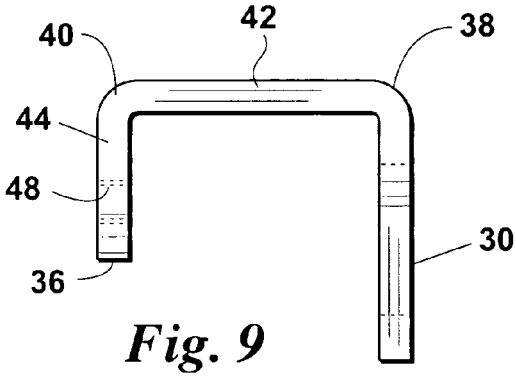
Fig. 9
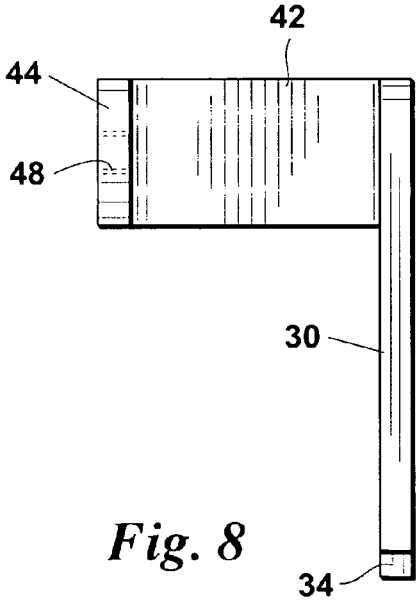
Fig. 8
Fig. 10
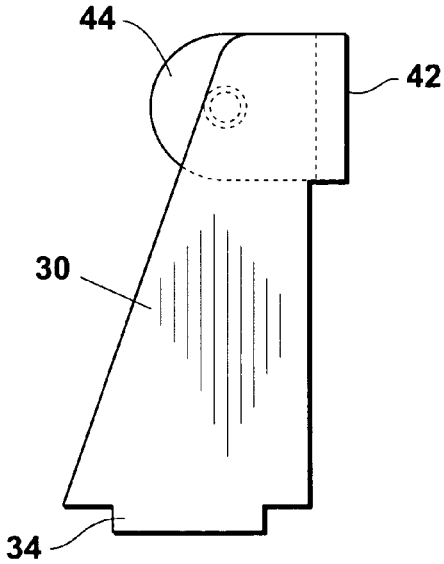

DEVICE TO IMPROVE PUTTING

BACKGROUND OF THE INVENTION

1. Field of the Invention

The present invention relates to a device to aid golfers in improving their putting game. More particularly, the present invention is a putting aid comprising a straight edge guide and a putter head attachment adapted for use in practicing the putting stroke or swing.

2. Prior Art

There are a number of patents that show or relate to putting aid devices. Some of the putting aid devices involve the use of a straight or elliptical track type member. It is believed to be novel to provide a guide member in combination with a putter head attachment which attaches to the putter head in a secure manner while simultaneously being removable and adjustable with relation to the putter. A preliminary patentability search was conducted on this invention and the following listed references were among those uncovered in the search.

| Patent No. | Inventor | Issue Date |
|---|---|---|
| 3,471,155 | Donaldson | Oct. 7, 1969 |
| 5,007,646 | Baber at el. | Apr. 16, 1991 |
| 5,024,442 | Sindelar, Sr. | Jun. 18, 1991 |
| 5,072,943 | Sindelar | Dec. 17, 1991 |
| 5,125,665 | Sindelar, Sr. | Jun. 30, 1992 |
| 5,150,904 | Sindelar | Sep. 29, 1992 |
| 6,561,920 B1 | Hamilton | May 13, 2003 |

Donaldson U.S. Pat. No. 3,471,155 discloses a golf training apparatus involving a "track" type system which contains the putter head to ensure a straight putt. The element of particular significance in this reference is the putter attachment itself, in that this particular attachment connects with the putter at the head of the putter, uses a thumbscrew mechanism to secure the attachment, and guides the putter head along a track. The thumb screw is used with totally different structure which is considerably more complicated than the present invention.

Baber, et al, U.S. Pat. No. 5,007,646 utilizes a "guide surface" comprising a flat bottom portion, a straight side portion, and an angled opposite side portion. However, Baber also shows a flattened top portion having groves therein and a sight located thereon.

Sindelar, Sr., U.S. Pat. No. 5,024,442 is quite similar to the Baber, et al., patent discussed above. The guide surface is provided with grooves along the top edge thereof, and the guide has a flat side and an angled side. Two opposite ends of the guide are provided with extended "tabs" (the patent refers to these as "ears"), each tab (ear) having a hole located centrally therein through which a golf tee may be inserted to secure the guide to the ground. Sindelar also recites an alternative means of securing the guide using hook-type fasteners which would stick to carpet.

Sindelar U.S. Pat. No. 5,072,943 recites a putter stabilizing and guiding system. This appears to incorporate the guide from the '442 patent in combination with a perpendicular device which can fit into a groove on the putter or ride alongside the putter head. The flat rear surface slides along the guide to maintain a straight stroke. This patent recites a means of coupling the perpendicular device to the putter head by various means, including tape, other adhesive, hook-and-loop fasteners, or a bolt which may be inserted into a pre-drilled or existing hole.

Sindelar U.S. Pat. Nos. 5,125,665 and 5,150,904 are both continuation-in-part applications relating back to the '943 and '442 patents discussed above. Both of these continue or add to the previous patents.

Hamilton, et al., U.S. Pat. No. 6,561,920 B1 recites a golf stroke aid guide device having a vertical front surface and an elliptical portion to replicate the curve or "swing circle" of the club head (as opposed to putt stroke). This guide may be secured to the ground by means of golf tees which may be inserted through the removable ground plate portion of the guide.

SUMMARY OF THE INVENTION

The present invention is a device to aid golfers in improving their putting game. The invention comprises an elongated straight edge guide which is used in conjunction with a putter attachment. The guide, for example, has a length of approximately twenty-three inches and has a substantially triangular cross-sectional shape. The putter attachment comprises a flat vertical base plate which is adapted to slide horizontally against a vertical side of the guide. The attachment also includes a first vertical arm extending perpendicularly in a vertical plane from the base plate. At the end of the first vertical arm opposite its attachment to the base plate is a horizontal arm which extends from an upper edge of the first vertical arm in a horizontal plane and in spaced relation with the base plate. The horizontal arm forms a right angle with the first vertical arm so as to extend over the uppermost portion of a putter head. A second vertical arm is attached to an opposite end of the horizontal arm and is provided with a hole therein through which a thumbscrew is threaded. The second vertical arm extends downwardly in spaced parallel relation with the first vertical arm. The thumbscrew extends through the hole in the second vertical arm and is provided with a screw cap. The thumbscrew extends in parallel spaced relation with the base plate.

The base plate is provided with a slot therein which corresponds to a tab located on one end of the first vertical arm such that, when the tab of the vertical arm is inserted into the slot of the base plate and welded to secure the tab in place, the slot will be slightly larger than the tab permitting limited side to side movement of the tab within the slot, so as to permit the base plate to be positioned by a golfer at an appropriate angle for the golfer's putter head. When installed onto a putter, the base plate is positioned behind the heel of the putter and the horizontal arm of the putter attachment is disposed across the upper edge of the putter head just in front of the club shaft, with the first vertical arm running along the putting face of the putter and the second vertical arm being located on the opposite side of the putter from the putting face. The thumbscrew, which is threaded through the hole in the second vertical arm is tightened until the screw cap firmly contacts a portion of the putter behind the face of the putter. The screw cap comprises a material such as plastic or rubber to prevent the thumbscrew from directly contacting the putter for the purpose of preventing scratching of the putter.

The straight edge guide is substantially triangular in shape, having a bottom side, an angled flat side, a vertical flat side, a first triangular end, and a second triangular end. Two holes are drilled along the angled flat side through the bottom side in perpendicular relation with the bottom side and in spaced relation from the first and second triangular ends through which a standard golf tee may be inserted to secure the guide in place on a grass or dirt surface. The bottom side of the guide may be provided with a strip of hook-and-loop fastening material which may be affixed to a corresponding hook-and-loop fastener on the floor surface for use indoors.

Once the putter attachment is firmly attached to a desired putter, the putter attachment is used in conjunction with the guide to practice a straight swing or stroke. Once the guide is secured in the desired location, either by means of the hook-and-loop fasteners or by inserting tees through the tee holes and into the ground, the golfer positions the base plate of the putter attachment so that it rides along the vertical flat side of the guide. The base plate of the putter attachment maintains constant contact with the vertical flat side of the guide, permitting a golfer to practice his/her straight putting stroke by "swinging" the putter along the flat vertical side of the guide. In this manner, he/she is able to achieve a straight putting stroke and to practice the same. The guide is twenty-three inches in length so as to correspond with the proper length of the putting stroke such that, when the putting aid device is used as indicated, the putter head attachment in conjunction with the guide length will "train" the golfer to achieve a straight stroke of proper length.

BRIEF DESCRIPTION OF THE DRAWINGS

FIG. 6 is an elevation of the first vertical arm of the attachment prior to the folding thereof to form the first horizontal arm and the second vertical arm.

FIG. 7 is a right hand end view of the structure shown in FIG. 6.

FIG. 8 is a left-hand end view from FIG. 6 showing the bending out therefrom of the first horizontal arm and the second vertical arm.

FIG. 9 is a top view taken from FIG. 8.

FIG. 10 is a right side view taken from FIG. 8.

DETAILED DESCRIPTION OF THE PREFERRED EMBODIMENTS

Figure 14:
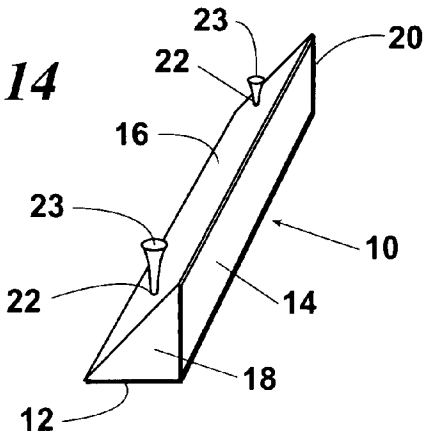
FIG. 14 is a perspective view of the guide itself which is used in conjunction with the putter head attachment.

Referring to the drawings in detail, FIG. 14 shows an elongated guide 10 which is substantially triangular in cross-sectional shape; being provided with a flat bottom (horizontal) side 12, a flat vertical side 14 and an angled flat side 16 which extends from the top of the vertical side 14 to the outer edge of the bottom side 12. The guide may be made of wood (preferably) or any other suitable material as long as a flat vertical surface, such as vertical side 14 is provided. Guide 10 also has a first triangular end 18 and an opposite second triangular end 20. A pair of holes 22 are drilled vertically from center locations along the angled flat side 16 through the bottom side 12 in perpendicular relation to the bottom side and in spaced relation from the first and second triangular ends. A standard golf tee 23 may be inserted through each of the holes 22 to secure the guide in place on a grass or dirt surface. Alternatively, the bottom side 12 of the guide may be provided with a strip of adhesive material such as hook-and-loop fastening material (not shown) and which may be made to stick to a corresponding strip of adhesive material such as hook-and-loop fastener material (not shown) on a floor surface for use indoors.

Figure 5:
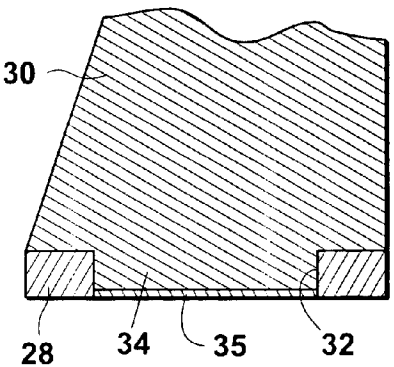
FIG. 5 is an enlarged view of the bottom portion of FIG. 4 with parts in section.

Referring to FIGS. 1 through 10, a putter head attachment 26 includes a base plate 28 which is vertically disposed and which is approximately one inch high and three inches long with curved edges as shown. Centrally located along the horizontal extent of the base plate 28 is a first vertical arm 30 which is secured into a vertical slot 32 located centrally on the base plate 28. For purely illustrative purposes, the slot 32 is preferably about 0.628" high and approximately 0.133" inches wide. The first vertical arm 30 is slightly over an inch high where it is connected with the base plate 28 and is provided with a rectangular tab 34 which is adapted to be received in the slot 32. The outer shape of the tab 34 corresponds exactly with that of the slot 32 so that when the first vertical arm 30 is positioned against the base place 28, the tab 34 extends substantially through the slot 32 except for a small space 35 as shown in FIG. 5. However, the end of the tab is covered with plug welding by filling the space 35 with welding material which is thereafter ground off prior to powder coating of the entire attachment 26. The base plate 28 and the arm 30 are both made of aluminum which is 0.125" thick. The width of the slot 32, however is slightly greater at 0.133". Therefore, after the plug welding and the grinding away of the excess, it is possible to have a limited side-to-side movement of the tab 34 within the slot as shown by the dashed lines in FIG. 12.

Turning now to FIG. 6 which is a side elevation of the first vertical arm 30 by itself; i.e., prior to folding of an elongated nose extension 36 thereof along fold lines 38 and 40 to provide a first horizontal arm and a second vertical arm as will hereinafter appear.

Referring now to FIG. 9, the nose portion 36 has now been bent along bending lines 38 and 40 to provide, first of all, a first horizontal arm 42 and a second vertical arm 44. The horizontal arm 42 extends rearwardly (in relation to FIG. 1) from the first vertical arm 30 in parallel spaced relation with respect to the base plate 28 while the second vertical arm 44 extends downwardly from the left hand end of horizontal base plate 42 downwardly in spaced parallel relation with the first vertical arm 30.

Figure 2:
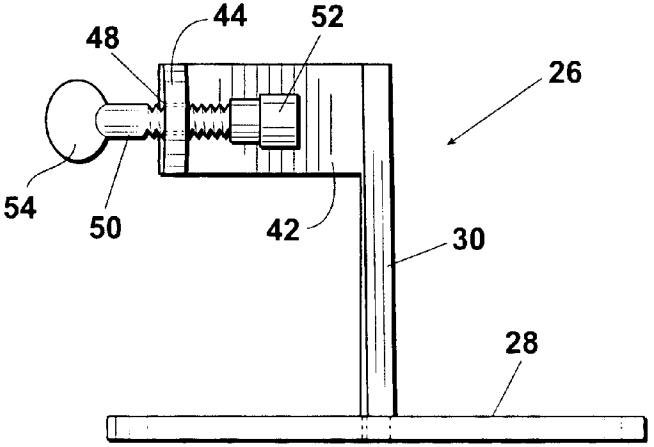
FIG. 2 is a bottom plan view of the elements shown in FIG. 1.

Referring now to FIGS. 7 and 8, the downwardly descending second vertical arm 44 is provided with a threaded hole 48 through which a shaft 50 of a thumbscrew is threaded (See now FIG. 2). A screw cap 52 is attached to one end of the thumbscrew shaft 50, whereas the opposite end is provided with a flattened portion 54 which serves as a handle for turning the thumbscrew.

Figure 12:
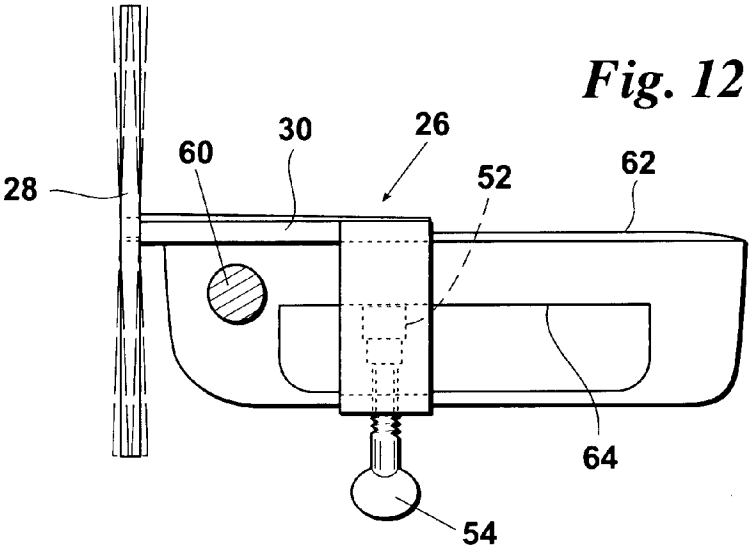
FIG. 12 is a top plan view taken along section line 12—12 of FIG. 11 and showing the putter head and the putter head attachment, the base plate shown by dashed lines as being movable to slightly different positions.
Figure 11:
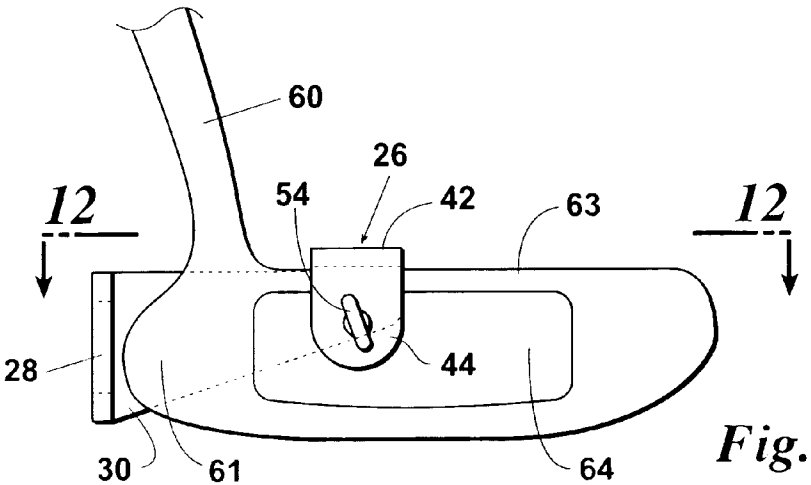
FIG. 11 is a front side view of the putter head attachment of the present invention being shown as attached to a putter head.
Figure 13:
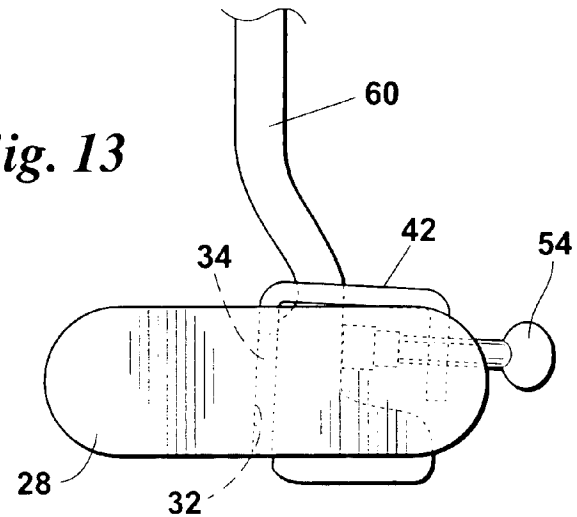
FIG. 13 is left-hand side view taken from FIG. 12.

FIGS. 11 to 13 show the manner in which the attachment 26 is attached to a putter 60. Referring to FIG. 11, it will be assumed that the putter 60 is for a right-handed person. In this case the attachment 26 is placed so that the base plate 28 is behind the heel 61 of the putter and the first vertical arm 30 is against and parallel to the putting face 62 of the putter. The attachment 26 is further positioned so that the first horizontal arm 42 will overlay a head 63 of the putter and the second vertical arm 44 will extend downwardly in parallel relation with the first vertical arm 30 and behind the putting face 62 of the putter. At this point in time the thumbscrew will be sufficiently loosened that the screw cap 52 will be spaced away from the rear face 64 of the putter on the opposite side of the putting face 62 and the shaft of the thumbscrew will be extending at right angles to the rear of the putter face. At this time the handle 54 of the thumbscrew is turned until the screw cap bears against the rear side of the putter. Continued turning of the thumbscrew will cause the putter head 63 to be gripped securely between the vertical arm 30 and the screw cap 52.

Once the putter attachment is firmly attached to a desired putter 60, the putter attachment 26 is used in conjunction with the guide 10 to practice a straight swing or stroke. Once the guide is secured in the desired location, either by means of the hook-and-loop fasteners or by inserting tees through the tee holes and into the ground, the golfer 66 positions the head of the putter 60 along the vertical flat side 14 of the guide 10. The base plate 28 of the putter attachment maintains constant contact with the vertical flat side 14 of the guide, permitting the golfer to practice his/her straight putting stroke by "swinging" the putter along the flat vertical side of the guide. In this manner, he/she is able to achieve a straight putting stroke and to practice the same. The guide is twenty-three inches in length so as to correspond with the proper length of the putting stroke such that, when the putting aid device is used as indicated, the putter head attachment in conjunction with the guide length will "train" the golfer to achieve a straight stroke of proper length.

Figure 16:
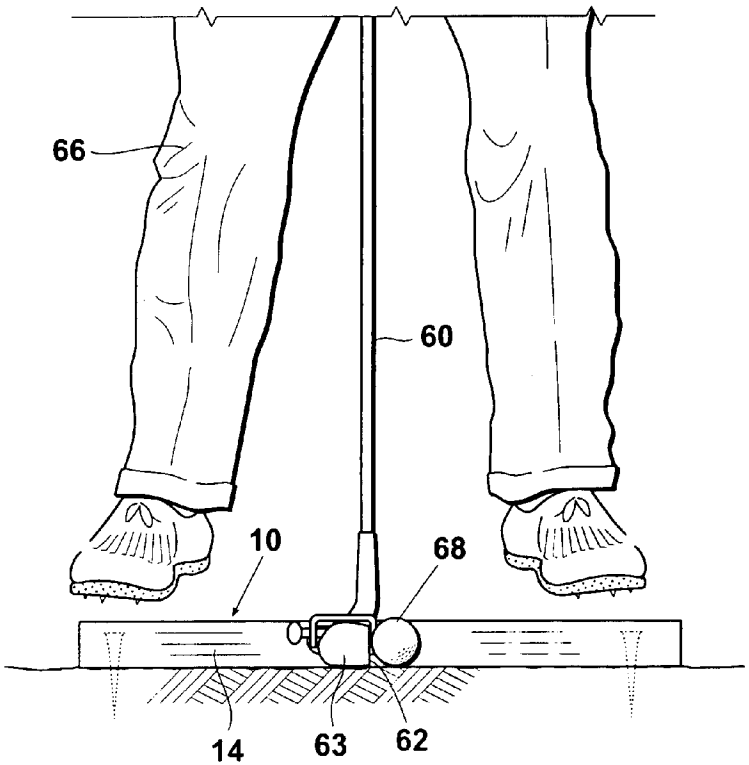
Figure 15:
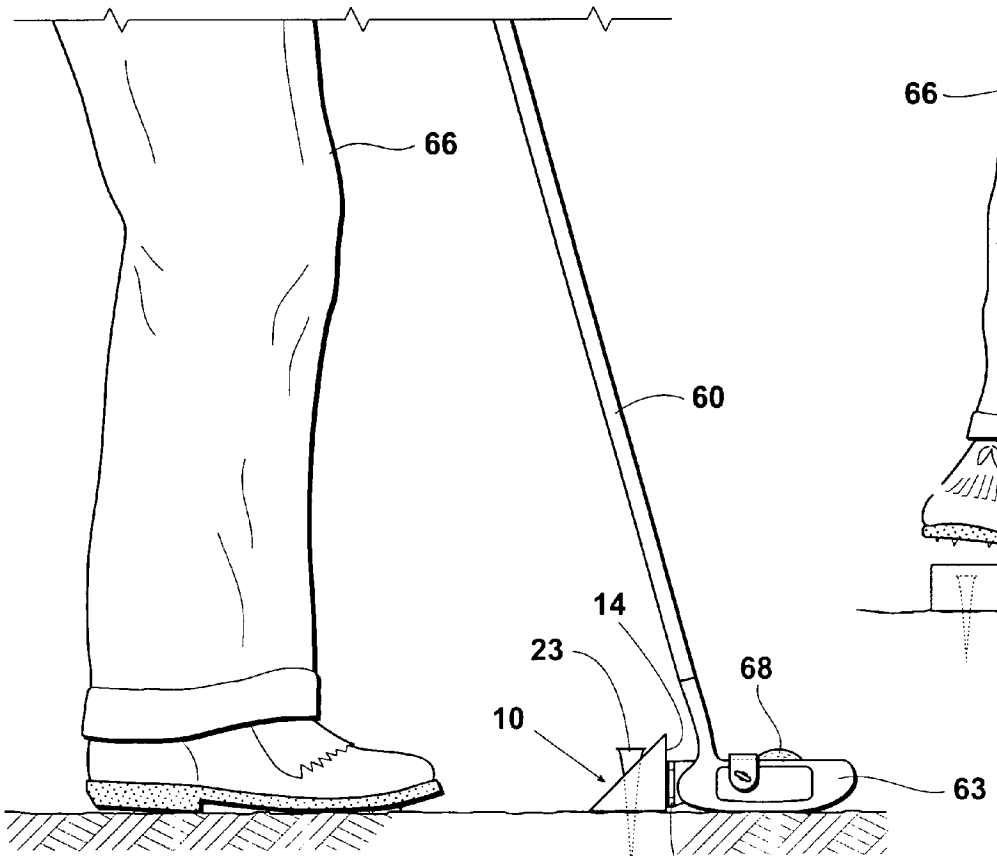
FIG. 15 is a view looking at one end of the guide and showing a golfer utilizing the putter head attachment and the guide, the putter being in essentially the same position as in FIG. 11; and, FIG. 16 is a right-hand side view taken from FIG. 15.

Consistent with the description in the last several paragraphs, FIGS. 15 and 16 show the manner in which the golfer 66 utilizes the guide 10 and the attachment 26 of the present invention. That is, in FIG. 15, the golfer 66 places the base plate 28 against the flat surface 14 of the guide 10. A golf ball 68 is placed on the green (not shown) adjacent the flat surface 14 and adjacent the putter face 62 as best shown in FIG. 16.

Figure 1:
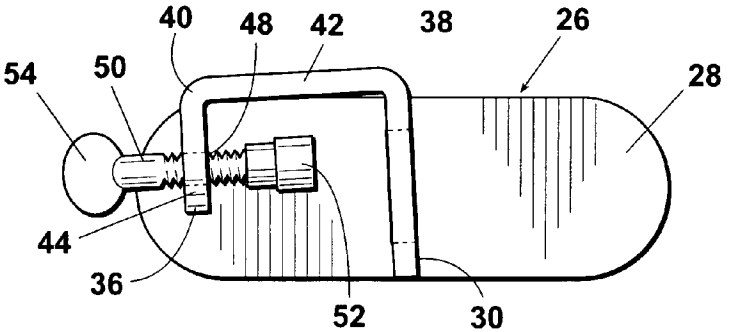
FIG. 1 is a front side elevation of the putter head attachment of the present invention.
Figure 3:
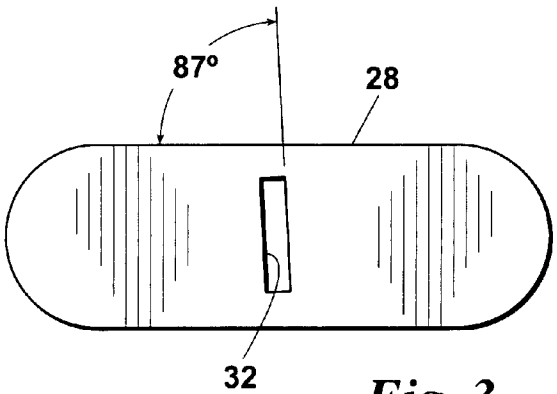
FIG. 3 is a front view of the base plate itself of the items shown in FIG. 1.
Figure 4:
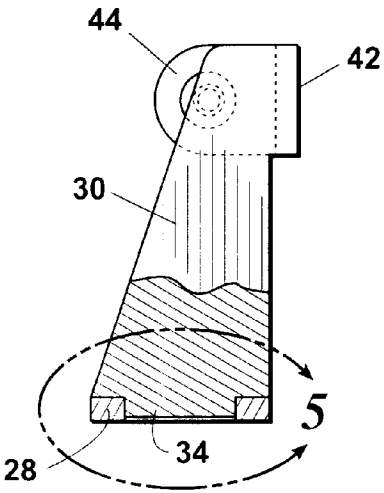
FIG. 4 is a left side view, partially in section, of the elements shown in FIG. 2.

Returning now to consideration of FIG. 3, the slot 32 is shown as having a slope of 87 degrees with respect to the horizontal. The reason for this is simply that the angle of the normal putter face is 3 degrees with respect to the vertical. When the first vertical arm 30, as it appears in FIG. 1, is snug against the putter face 62, the base plate 28 is still in a horizontal disposition, as also shown in FIG. 15, where the base plate 28 is horizontal with respect to the flat surface 14.

Whereas the present invention has been described in particularly relation to the drawings attached hereto, it should be understood that other and further modifications of the present invention, apart from those shown or suggested herein may be made within the spirit and scope of the invention.

What is claimed is:

1. A device to aid golfers in improving their putting game comprising a straight edge guide, a putter attachment, and a putter; wherein the putter includes a shaft, a putter head attached to the shaft, a putting surface on the putter head, a rear face spaced rearwardly from the putting face, the putter attachment comprising an elongated flat vertical base plate which extends horizontally and is adapted to slide against a horizontal flat surface on the guide, the attachment also including a first vertical arm extending perpendicularly in a vertical plane from the base plate, a horizontal arm extending from an upper edge of the first vertical arm in a horizontal plane from an end of the first vertical arm opposite its attachment to the base plate, the horizontal arm extending in spaced relation with respect to the base plate, the horizontal arm forming a right angle with the first vertical arm so as to extend over an uppermost portion of the putter head, a second vertical arm attached to an end of the horizontal arm opposite from its attachment to the first vertical arm and extending downwardly in parallel relation with the first vertical arm, the second vertical arm being provided with a hole therein through which a thumb screw is threaded, the thumb screw extending through the hole in the second vertical arm in parallel spaced relation with the base plate and being provided with a screw cap on an internal end thereof, the thumb screw being provided with a handle at the exterior end thereof opposite from the screw cap for turning the thumb screw, the screw cap being adapted to bear against a rear face on the putter head when the thumb screw is turned sufficiently so that the putter head is grasped between the first vertical arm and the screw cap whereby a golfer can position the putter with the putter attachment thereon so that the base plate of the attachment lies against a flat surface on the guide and the golfer can practice swinging the putter while the base plate remains in contact with the flat surface of the guide.

2. A device to aid golfers as set forth in claim 1 wherein the first vertical arm is connected to the base plate by means of a vertical tab on the first vertical arm which is received in a vertical slot in the base plate, the slot and the tab being oriented at 87 degrees with respect to the horizontal.

3. A device to aid golfer as set forth in claim 2 wherein the width of the slot is slightly greater than the thickness of the tab, the length of the tab is less than the depth of the slot, leaving an elongated narrow space where the tab is received in the slot, whereby the narrow space can be filled by plug welding to permit a limited side-to-side movement of the tab in the slot.

4. A putter attachment for a putter head comprising an elongated flat vertical base plate which extends horizontally, a first vertical arm extending perpendicularly in a vertical plane from the base plate, a horizontal arm extending from an upper edge of the first vertical arm in a horizontal plane from an end of the first vertical arm opposite its attachment to the base plate, the horizontal arm extending in spaced relation with respect to the base plate, the horizontal arm forming a right angle with the first vertical arm so as to extend over an uppermost portion of the putter head, a second vertical arm attached to an end of the horizontal arm opposite from its attachment to the first vertical arm and extending downwardly in parallel relation with the first vertical arm, the second vertical arm being provided with a hole therein through which a thumb screw is threaded, the thumb screw extending through the hole in the second vertical arm in parallel spaced relation with the base plate and being provided with a screw cap on an internal end thereof, the thumb screw being provided with a handle at the exterior end thereof opposite from the screw cap for turning the thumb screw, the screw cap being adapted to bear against a rear face on the putter head when the thumb screw is turned sufficiently so that the putter head is grasped between the first vertical arm and the screw cap whereby a golfer can position a putter with the attachment on the head of the putter so that the base plate of the attachment lies against a flat surface on a guide and the golfer can practice swinging the putter while the base plate remains in contact with the flat surface of the guide.

5. A device to aid golfers as set forth in claim 4 wherein the first vertical arm is connected to the base plate by means of a vertical tab on the first vertical arm which is received in a vertical slot in the base plate, the slot and the tab being oriented at 87 degrees with respect to the horizontal.

6. A device to aid golfer as set forth in claim 5 wherein the width of the slot is slightly greater than the thickness of the tab, the length of the tab is less than the depth of the slot, leaving an elongated narrow space where the tab is received in the slot, whereby the narrow space can be filled by plug welding to permit a limited side-to-side movement of the tab in the slot.

* * * * *